United States Patent [19]

Speer

[11] 4,094,294

[45] June 13, 1978

[54] BALL PROJECTING DEVICE

[76] Inventor: Richard Speer, Ware Neck, Va. 23178

[21] Appl. No.: 764,197

[22] Filed: Jan. 31, 1977

[51] Int. Cl.[2] ..... F41F 1/04

[52] U.S. Cl. ..... 124/56; 124/41 C; 124/50; 124/51 R

[58] Field of Search ..... 124/41 R, 41 C, 49, 124/50, 51 R, 52, 53, 56, 71, 72, 73; 56/328 R, 332

[56] References Cited

U.S. PATENT DOCUMENTS

| | | | |
|---|---|---|---|
| 1,743,576 | 1/1930 | Smith | 124/72 |
| 2,646,785 | 7/1953 | Goldman | 124/51 R X |
| 3,584,614 | 6/1971 | Horvath | 124/56 |
| 3,664,104 | 5/1972 | Jamshidi | 56/332 |
| 3,756,001 | 9/1973 | Macidull | 56/328 R |
| 3,847,132 | 11/1974 | Schatz | 124/50 X |
| 3,855,988 | 12/1974 | Sweeton | 124/56 |
| 3,905,349 | 9/1975 | Nielsen et al. | 124/56 X |
| 3,930,486 | 1/1976 | Kahelin | 124/72 |
| 3,978,841 | 9/1976 | Yarur et al. | 124/50 |
| 4,027,646 | 6/1977 | Sweeton | 124/56 |

FOREIGN PATENT DOCUMENTS

| | | | |
|---|---|---|---|
| 1,185,096 | 1/1965 | Germany | 124/56 |

*Primary Examiner*—Richard T. Stouffer
*Attorney, Agent, or Firm*—Barry G. Magidoff

[57] ABSTRACT

A ball projecting device is provided for propelling a ball pneumatically, wherein the speed of the ball projected is, at least in part, determined by utilizing a pneumatically operated, preferably variable, detent in the barrel of the device. The detent holds the ball within the barrel until a predetermined air pressure is built up behind the ball, which then causes the detent to quickly, almost immediately, collapse, permitting the ball to be projected out of the barrel.

The invention further comprises a ball feeding mechanism, for feeding projectile balls to the barrel, the feeding mechanism comprising a rotating multi-apertured disk, rotating about an axis transverse to the horizontal and an overhanging ball guard device to prevent the blocking of the feed mechanism with a plurality of balls.

26 Claims, 15 Drawing Figures

BALL PROJECTING DEVICE

This invention is directed to a device for the projecting or "throwing" of spherical articles, or balls, and in particular to an improved pneumatically operated projecting device for the throwing of balls such as tennis balls, baseballs and the like.

The prior art is well acquainted with a variety of pneumatically operated devices for the projecting or throwing of a wide variety of balls, including relatively heavy baseballs, medium weight tennis balls, or ping pong balls. Such devices also include means for providing a supply of such balls for automatically feeding the pneumatic projectile device with a large number of balls to be projected at a pre-defined rate. Such devices generally comprise a means for developing pneumatic pressure, generally air pressure, means to feed a ball into a barrel, behind which the gas pressure is developed, and a releasable detent means in the barrel for restraining the ball until a predetermined pressure has been developed behind the ball for providing the desired velocity. Such detent means have included spring-loaded detent means such as buttons, or elastic members, or collars, located within or at the end of the barrel. Reference is made, for example, to U.S. Pat. Nos. 2,574,408; 3,009,703; 2,357,951; 3,584,614; 3,905,349; and 3,855,988. Some of these patents also provide means for varying the speed of the ball as it is projected from the barrel. For example, Sweeton, U.S. Pat. No. 3,855,988, describes means for varying the speed of the ball by adjusting the bias spring pressure acting against the detent button, or by varying the pressure of the air behind the ball after the ball has passed the detent area.

Such a detent button type means provides a detent which unfortunately permits the leakage of the pressurized gas between the ball and the remaining portion of the barrel. A tighter seal, is of course obtained utilizing an elastic sleeve, such as is shown in U.S. Pat. No. 3,905,349. However, the velocity of the ball projected through the sleeve in the patent to Nielson et al is not varied by varying the detention force exerted by the detent means, but rather by a more complicated system of varying the air flow behind the ball.

In accordance with the present invention, there is provided a device for projecting a ball by pneumatic means, through a barrel. There is provided inflated means in the barrel for transiently restraining the movement of a ball therethrough until a predetermined pressure is developed behind the ball, the detent means being automatically deflated upon the achievement of such pressure so as to permit the passage of the ball at the desired velocity. The inflated detent means is relaxed by a direct pneumatic pressure connection between a valve closing off the interior of the inflated detent means and a pressure source, the pressure of which is increased as the pressure behind the ball is increased. Upon the attainment of the desired pressure, the detent valve is moved into the open position, thus permitting the inflated detent to deflate and collapse, sufficiently to immediately permit the projection of the ball under the force exerted by the gas pressure therebehind through the barrel and out at the desired velocity.

This invention further provides means for pneumatically varying the resistance provided by a detent means subject to the gas pressure exerted upon the ball to be projected.

It is a further object of this invention to provide ball guard means and ball feeding means which result in the feeding of a single ball, without jamming, into the projection barrel. It is a further object of this invention to provide a compact, light weight device for automatically projecting a plurality of balls at a desired velocity and at a desired unit rate.

A further understanding of the invention and the preferred embodiments for achieving the desired objects are set forth in the embodiments illustrated in the accompanying drawings. The illustrated embodiments, however, are intended merely to be exemplary of the presently known preferred means for carrying out the invention, and are not intended to be exclusive of the full scope of the invention.

Referring to the drawings:

FIG. 1 is a perspective view of the complete apparatus in operation;

FIG. 1*a* is a perspective view of the complete apparatus in its portable carrying condition;

Figure 1:
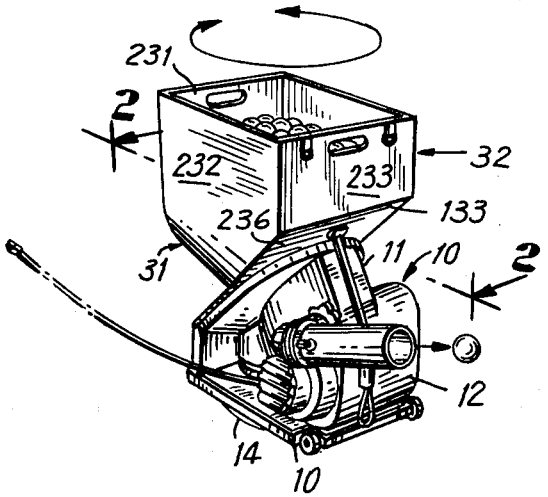

Referring to the drawings, the embodiments of the invention described therein comprise a body portion, generally indicated by the numeral 10, which includes an air chamber lower portion 12, which in turn is in fluid flow connection with the output end of a blower 16, and an upper, ball chute portion 11. The body 10 is rotatably connected to and rests upon turntable 14, and in turn can be driven in oscillating rotating motion relative to the base 14 by the oscillating gear motor 15; the drive shaft 13 is rotatably connected to the turntable base 14 via eccentric bearing block 17.

The angled barrel, generally indicated by the numeral 25, is rotatably connected to the body 10 and secured by a knurled nut 27 to a complementarily threaded barrel stub 26. The inner elbow portion 28 is connected to the outer barrel portion 29 of the barrel 25 by a flange member, generally indicated by the numeral 30. The barrel stub 26 is formed in the upper portion of the air chamber 12, substantially at the interface with the ball chute portion 11.

Rotatably secured to an upper transverse surface 29 of the ball chute portion 11 is a ball feeder dial, or disk, 34. The dial 34 has four openings 36 therethrough, equidistantly arranged around the outer peripheral portion of the feeder dial 34. The transverse surface 29 of the case 10 and the rotatable dial 34 lie at an angle of about 45° to the horizontal when the turntable 31 and the body 10 are resting on a horizontal surface, and more generally at an angle of from about 35° to 50° to the horizontal. The central portion of the feeder dial 34 comprises a bumper member 38 protruding upwardly away from the surface 34, and having a castellated upper surface 39; each of the four castellations 39*a, b, c, d* is substantially a truncated semi-pyramid, the corners 41 of opposite castellations, i.e., 39*a, c,* and 39*b, d,* extending along mutually perpendicular diameters of the feeder dial 34. The openings 36 are preferably formed in a slightly oblong shape, the longer axis being perpendicular to the diameters of the feeder dial 34.

A lower feeder dial 42 is rigidly secured at its perimeter to the upper feeder dial 34. Lower feeder dial 42 comprises four equidistantly arranged feeder chutes 43 disposed immediately beneath the upper dial openings 36. The entire dial, comprising the upper feeder dial 34 and lower feeder dial 42, is rotatably mounted to the transverse surface 29 via a drive coupling shaft 46 extending through the transverse surface 29 from a feeder gear motor 45 within the air chamber portion 12. A restrictor plate 40 is pivotally secured by a pin 40*a* between the feeder dial 34 and lower feeder dial 42, so as to be pivotable into and out of a position closing off the dial openings 36.

A ball feed port 50 is formed through the transverse surface 29 at an upper portion thereof and so positioned as to be located beneath the openings 36 through the feeder dial 34 as the feeder dial rotates and passes over that portion of the transverse surface 29. A ball chute is formed between an internal compartment wall 21 connected to the blower compartment wall 20 and the outer walls of the ball chute portion 11. A flap valve 52 is hingedly connected to the inner portion of the upper transverse surface 29, by hinged pin 53, and is capable of being pivoted about the hinge 53 so as to completely close the port 50 when in its upper position pressing against the rim 150 of port 50, which acts as a valve seat. The lower portion of the ball chute compartment wall 21 is formed with an opening connecting to the air chamber 12, which in turn is partially restricted by a baffle 55. The lower end of the ball chute 11 opens into the barrel stub 26.

Figure 2:
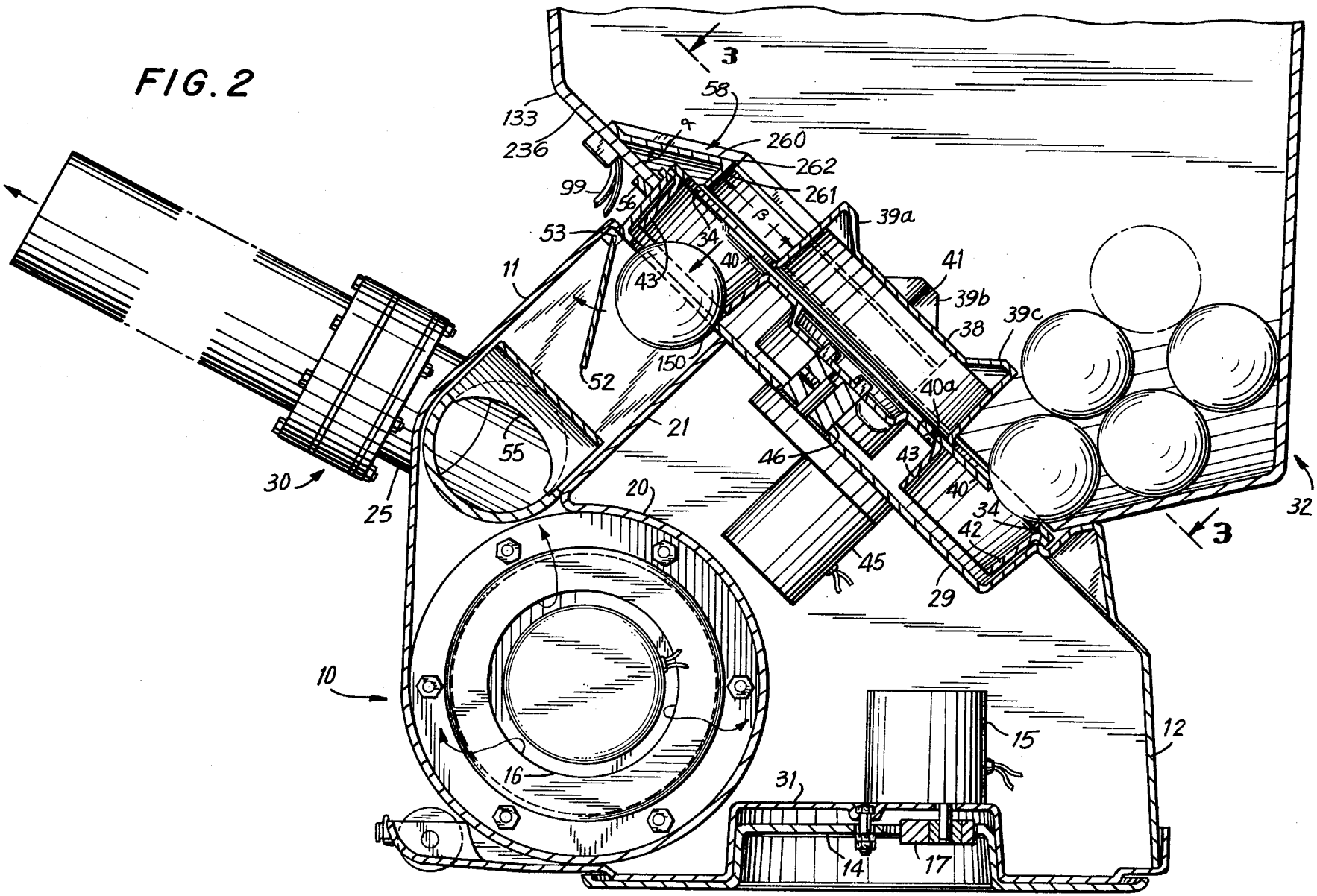
FIG. 2 is an enlarged side elevation view along line 2—2 of FIG. 1.

A hopper 32, is positioned as shown in FIG. 2 so as to be supported by the body portion 10. The hopper 32 has an upper portion 33 having a generally rectangular cross-section, albeit preferably with rounded interior corners, extending to the upper knuckle 133. All four sides, 231, 232, 233 and 234, have a slight inward slant downwardly, tending to come together towards the body portion 10. The lower portion 31 of the hopper 32, extending downwardly from the upper knuckle 133 is of a irregular shape, the bottom curved surface 34 comprising a semi-ellipsoidal cross-section, the straight portions of the two long sides 232, 234 of the hopper joining the curved surface at tangents to the curve. The longitudinal axis of the curved surface 134 is tilted from the horizontal at an angle of about 12°, or more generally at from about 5° to about 15°.

A lower transverse surface 236 extends from the upper knuckle 133 to the lowest point of the curved surface 134, and is substantially parallel to the transverse face 29 on the body portion 10. An opening defined by the curved interior surface 336 is formed through the lower transverse surface 236 such that when the hopper 32 is secured in operating position to the body portion 10, the feeder dial 34 protrudes therethrough, permitting any balls within the hopper 32 to fall within the feeder openings 36.

Figure 1A:
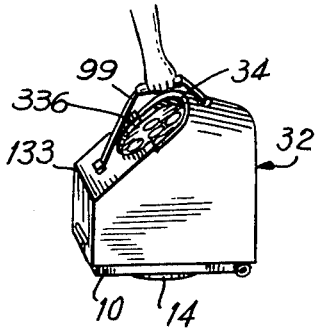

In its preferred embodiment, the hopper 32 is detachable from the body portion 10 and can be used as a cover therefor in the inverted position shown in FIG. 1*a*. A removable carrying handle 99 is provided.

A ball guard ledge 58 is rigidly connected to the hopper wall 32 and so positioned as to extend inwardly towards the center of the hopper so as to least partially overhang the ball feed port 50 and any of the dial feeder openings 36 juxtaposed above the ball feed port 50. The guard ledge 58 comprises a ledge shelf surface 260 extending at an angle, $\alpha$, of from about 1° to about 15° relative to the horizontal, but preferably not more than about 5°, and a lower transverse surface 261 extending towards, and substantially perpendicular to, the dial plate 34, the two surfaces intersecting at an apex 262.

It has been found that the spacing of the guard ledge shelf surface 261 and the side of the bumper member 38 and the angle that the guard ledge shelf surface 260 forms relative to the surface of the feeder dial 34 are significant in trying to avoid the simultaneous feeding of multiple balls to the ball feed port 50, and so preventing undesirable blocking of the ball chute 21 during use. Most preferably, that portion of the ledge apex 262 directly above the ball feed port 50 has an arcuate concavity shown in exaggerated size in FIG. 3, generally in the form of an arc of a circle concentric with the feeder dial 34 and in this case of a diameter approximately 4.5 to 5.5 times the diameter of the balls being projected. The location and size of the ledge 60, of course, depend upon the diameter of the balls being projected by the device, the device shown in the drawings being specifically utilized for tennis balls.

The castellated bumper member 38, 39 on the feeder dial is also effective to prevent jamming of the balls in the hopper and to insure a continuous feeding of balls into the feeder openings 36 in the feeder dial 34. Further, the angle of the feeder dial 34 to the horizontal is also crucial in insuring the continuous feed.

Turning now to one means for varying the velocity of the projected ball from the barrel 25, the flange unit 30 comprises three segments: an outer flange portion 60 formed integral with the outer barrel portion 29, an inner flange portion 62 formed integral with the inner barrel portion 28, and a central portion 63, firmly clamped between the inner and outer flange members 62, 60. In this embodiment, i.e., as shown in FIGS. 5 through 9, a circular bladder or membrane 65, having flared outer ends, is clamped at its outer ends between the outer flange 60 and central flange 63 and inner flange 62 and central flange 63, respectively, so as to define a detent volume with the central flange portion 63. The flange unit 30 is held in the clamped position by a plurality of threaded nut and bolt-type fasteners 61. If desired, a portion of the wall of the membrane or diaphragm 65 can additionally be adhesively secured, preferably to the central flange portion 63.

Vent holes 70 and 71, 71*a* are formed through the central flange member 63 connecting the detent volume to the atmosphere. When the flange 30 is assembled, the detent volume is otherwise in airtight sealed relationship to the atmosphere. A ball check member 75 is staked within a portion of the vent 70, so as to be capable of being sealably seated against valve seat 70*a*. The membrane 65 is elastically resilient and tends to maintain the expanded shape shown in FIG. 7, unless pressure is otherwise exerted thereagainst. The spool valve vent 71 is in fluid-flow connection with a spool valve chamber, defined by surfaces 73 within the central flange portion 63 and surfaces 77 in the upper flange portion 60. An actuating vent 77 (connecting in fluid pressure relationship the inner barrel and the spool valve chamber 75) is formed through the wall of the inner barrel portion 28 and the inner flange portion 62, connected by a corresponding vent through a vent block 78 secured between those two portions. A second relief vent hole 71*a* is formed through the outer wall of the spool valve chamber 73.

A spool valve member 80, having a lower face 80*a*, is slidably held within the valve chamber 73 and is biased towards the lower portion of the membrane 65, closing off the vent 71 and abutting the actuating vent 77. A biasing spring 81 acts against the upper portion of the spool valve member 80. An annular notch, defined by concave surfaces 82, is formed about the circumference of valve member 80 in such a position that when the notch 82 is in connecting relationship between vents 71 and 71*a* the detent volume 65, 63 is in fluid-flow connection with the atmosphere.

The lower portion of the spool valve member 80, including the lower face 80*a*, is a pressure-responsive means. The upper portion of the spool valve member 80, including especially the outer surface 80*b*, acts together with the vent 71 as a valve, closing off the connection between the spool valve vent 71 and relief vent hole 71*a*.

A bias control stem 85 is slidably secured within an opening through the upper surface of the valve case 77 and acts against the upper end of bias spring 81. A lower portion of stem 85 has a narrower dimension and extends through the center of the spring 81, into and through a slot formed into the top of the valve member 80. The upper end of the bias regulating stem 85 is in contact with a control dial 87, eccentrically rotatably connected to the outer barrel portion 29.

Figure 10:
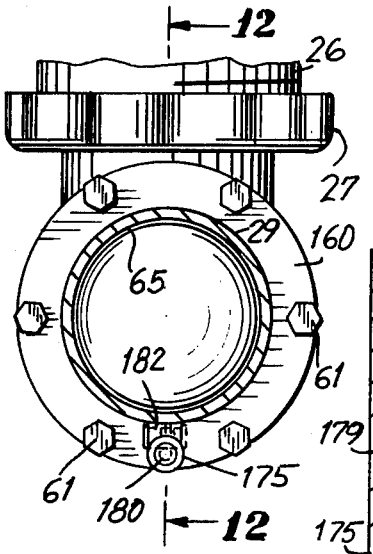
FIG. 10 is the same view as FIG. 5 of an alternative embodiment of a barrel and detent means.
Figure 12:
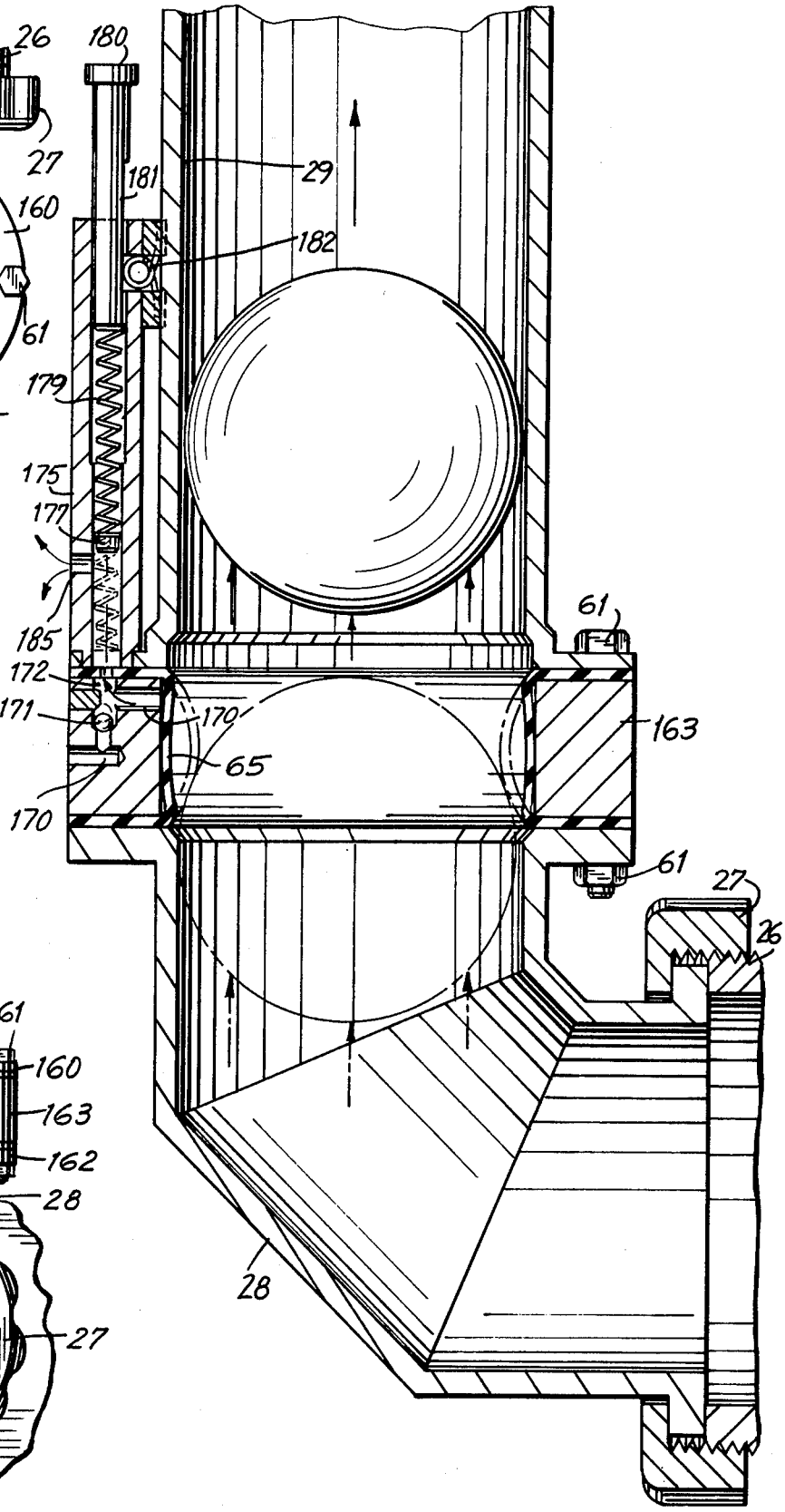
FIG. 12 is a sectional view taken along line 12—12 of FIG. 10.
Figure 11:
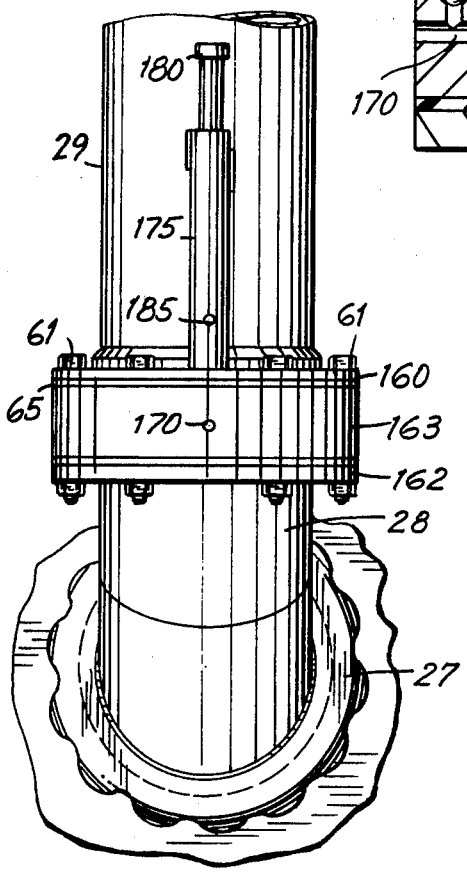
FIG. 11 is a side elevation view of the alternative embodiment of FIG. 10.

An alternative embodiment of the detent control valve is shown in FIGS. 10–12.

The second preferred embodiment described in the drawings of FIGS. 10, 11 and 12 utilizes the same type of inflatable detent membrane 65, but a different type of variable relief valve for setting the pressure required to deflate the detent membrane. In this case, the pressure tap for the spool valve is in fluid pressure connection with the detent volume defined by the membrane 65 and the central flange portion 163.

An angled intake vent, defined by surfaces 170, containing a check ball 171 staked therein, provides a passage for the entry of atmospheric air into the detent volume 65, 163. A second vent system, defined by surfaces 170, 172, connects to a chamber within a vent valve chamber 175. A spool valve member 177 is slidably disposed within the valve chamber 175 and biased towards the membrane 65, by a bias spring 179. A bias adjusting plunger 180 is also slidably retained within the upper portion of the valve chamber 175 and the lower end of the plunger 180 presses against the upper end of the bias spring 179. A rat trap spring 182, the ends of which are held rigidly in place against the barrel 29, serves to lock the plunger in any desired vertical position to which it is depressed. An exhaust vent, defined by inner surfaces 185 is formed through the side wall of the valve chamber 175.

Figure 13:
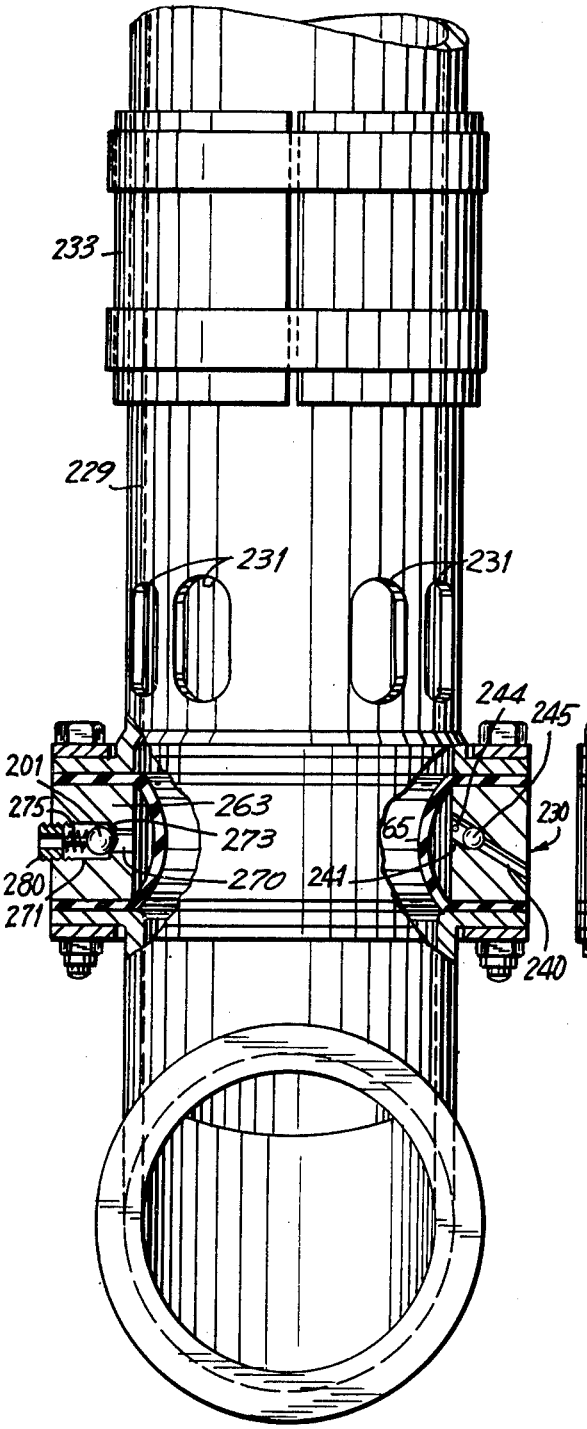
FIG. 13 is a partially cut-away front elevation view of the barrel showing a third alternative form of the detent means.
Figure 14:
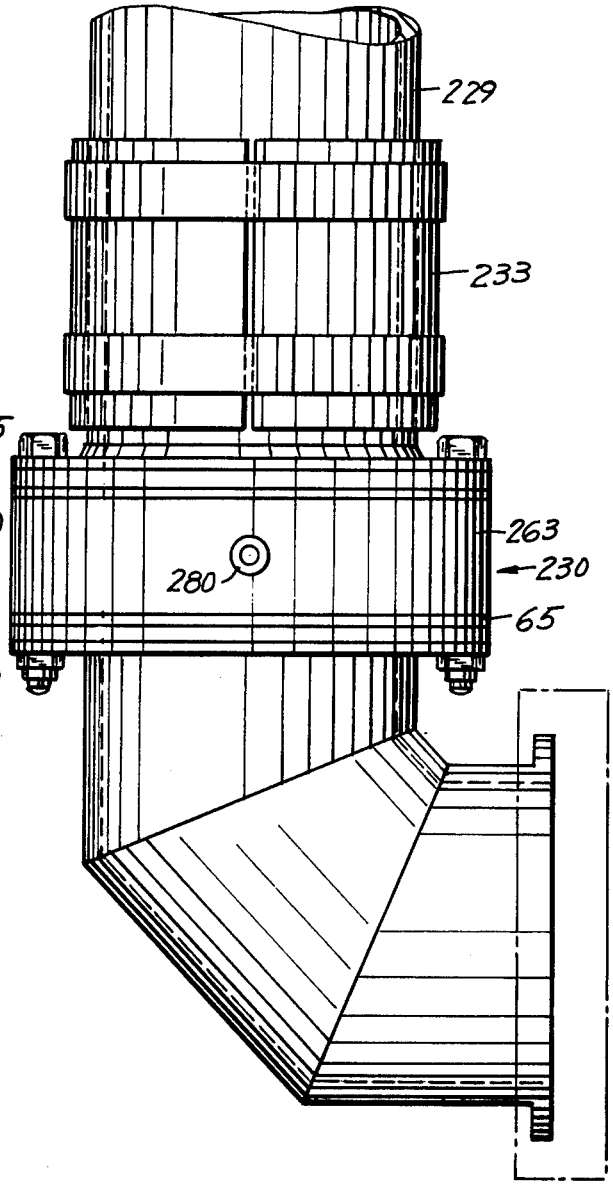
FIG. 14 is a side elevation view of the embodiment of FIG. 13.

Another alternative embodiment of the detent means of this invention is shown in FIGS. 13 and 14.

In this third preferred embodiment, yet another type of relief valve is provided for deflating the detent membrane. The pressure tap for the relief valve, a ball check valve 201, as shown, is in fluid pressure connection with the detent volume, defined by the elastically flexible membrane 65 and the central flange portion 263, via a vent defined by surfaces 270. The check ball 201 is slidably disposed within a valve chamber 271 and biased towards a valve seat 273 by a helical coil spring 275. The coil spring 275 is held in the valve chamber 271 and against the ball check 201, by the threaded cylindrical plug 280. A hole is formed centrally through the threaded plug 280, connecting the valve chamber 271 with the atmosphere.

An obliquely angled vent 240 is formed through another portion of the central flange portion 263, connecting a larger diameter vent valve chamber 241 to the atmosphere. A ball check 243 is held within the valve chamber 241 by a stake 244, and lightly biased against a valve seat 245 by its own weight.

The embodiment also provides an alternative means for varying the velocity of a ball projected from the device. The outer barrel 229, at a location relatively close to the flange unit 230, has formed therethrough, about its circumference, a series of spaced, preferably elongated, openings 231, connecting the interior of the barrel to the atmosphere. A sleeve 233 is slidably disposed about the outer barrel 229 capable of moving in and out of sealing juxtaposition with the openings 231. The sleeve 233 is a sufficiently snug fit to seal off the opening 231, and not to slide along the barrel 233 unless forcibly moved by an operator. This snug fit provides locking means for securing the sleeve at a desired position along the barrel.

Each of the preferred embodiments illustrated by the drawings include all of the various improvements which form a part of the present total invention. It is understood, of course, that if desired, any one aspect of the improvements in accordance with the present invention can be utilized without including the other aspects, although, of course, the combination of the various improvements results in the most desirable embodiment of all.

In operation, a plurality of balls, for example, tennis balls, are placed within the hopper 32. Because of the angle at which the feeder dial 34 is disposed to the horizontal, the location of the bumper member 38 and the guard ledge 58, there is little likelihood that the balls would become jammed either within the hopper or after passing into the ball chute 21. The gear motor 45 is activated, causing the feeder dial 34 to rotate at a continuous rate of, for example, 2 rpm. The balls can thus be fed into the ball chute 21 at a rate of either 8 balls per minute, if all four of the feeder openings 36 are exposed, or at some lesser rate determined by closing any of the feeder openings 36 by pivoting the corresponding restrictor plate 40 into the position indicated in the lower part of FIG. 3.

As the dial 34 rotates, a ball in each nonrestricted feeder opening 36 moves with the dial 34 by rolling along the top of the transverse surface 29, in the manner of a ball bearing, until reaching its apogee, or uppermost position, i.e., directly above the feed port 50. Any additional balls which may be lodged against the ball in a feeder opening 36 is moved aside by the guard ledge 58. In a preferred embodiment the dimension $\beta$ is slightly smaller than the diameter of the tennis balls, for example, in the range of from about 1/32 in. to about ⅛ in. less than the ball diameter, and optimally about 1/16 in. less than the ball diameter.

Figure 3:
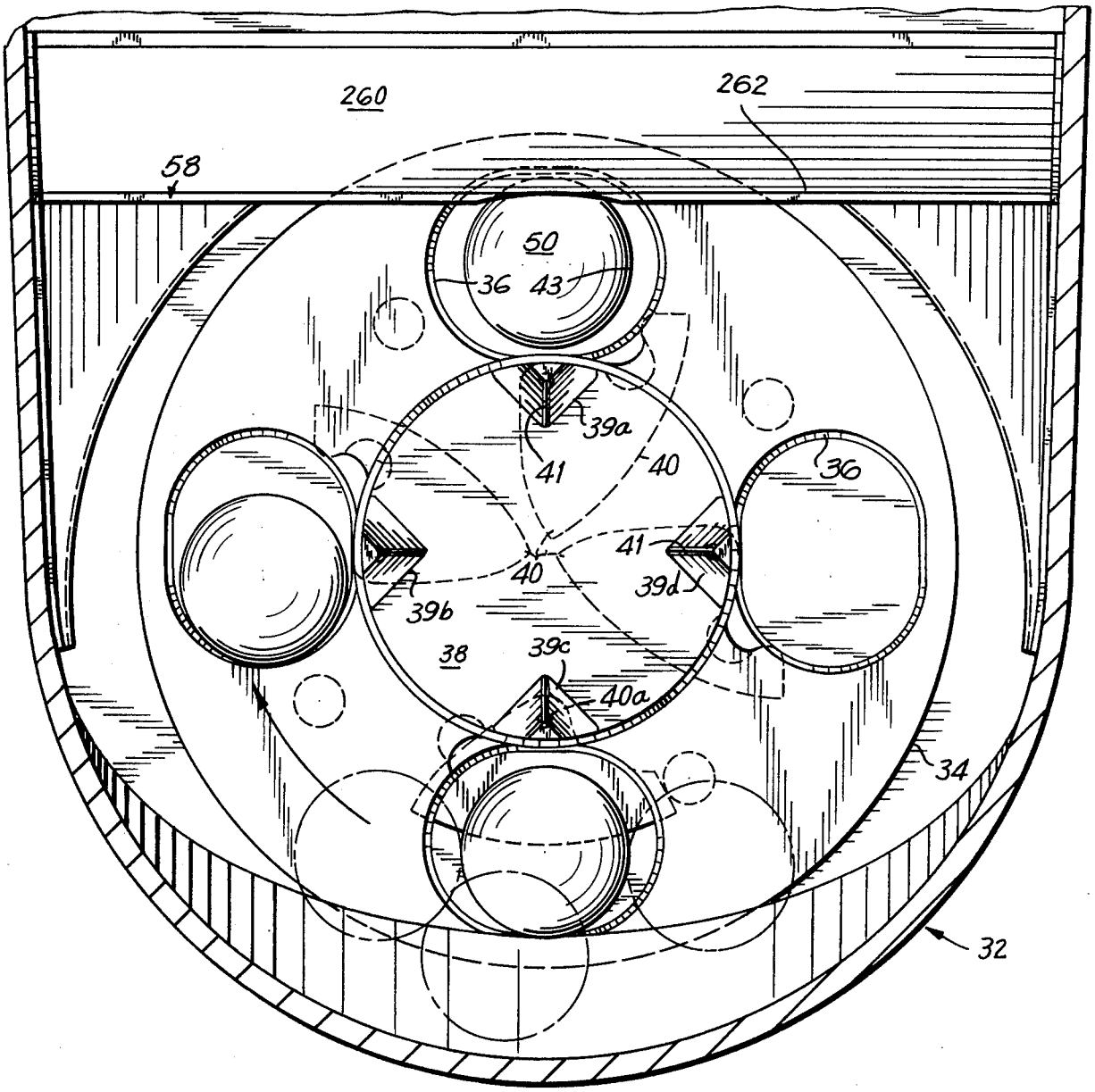
FIG. 3 is a sectional view taken on line 3—3 of FIG. 2.
Figure 4:
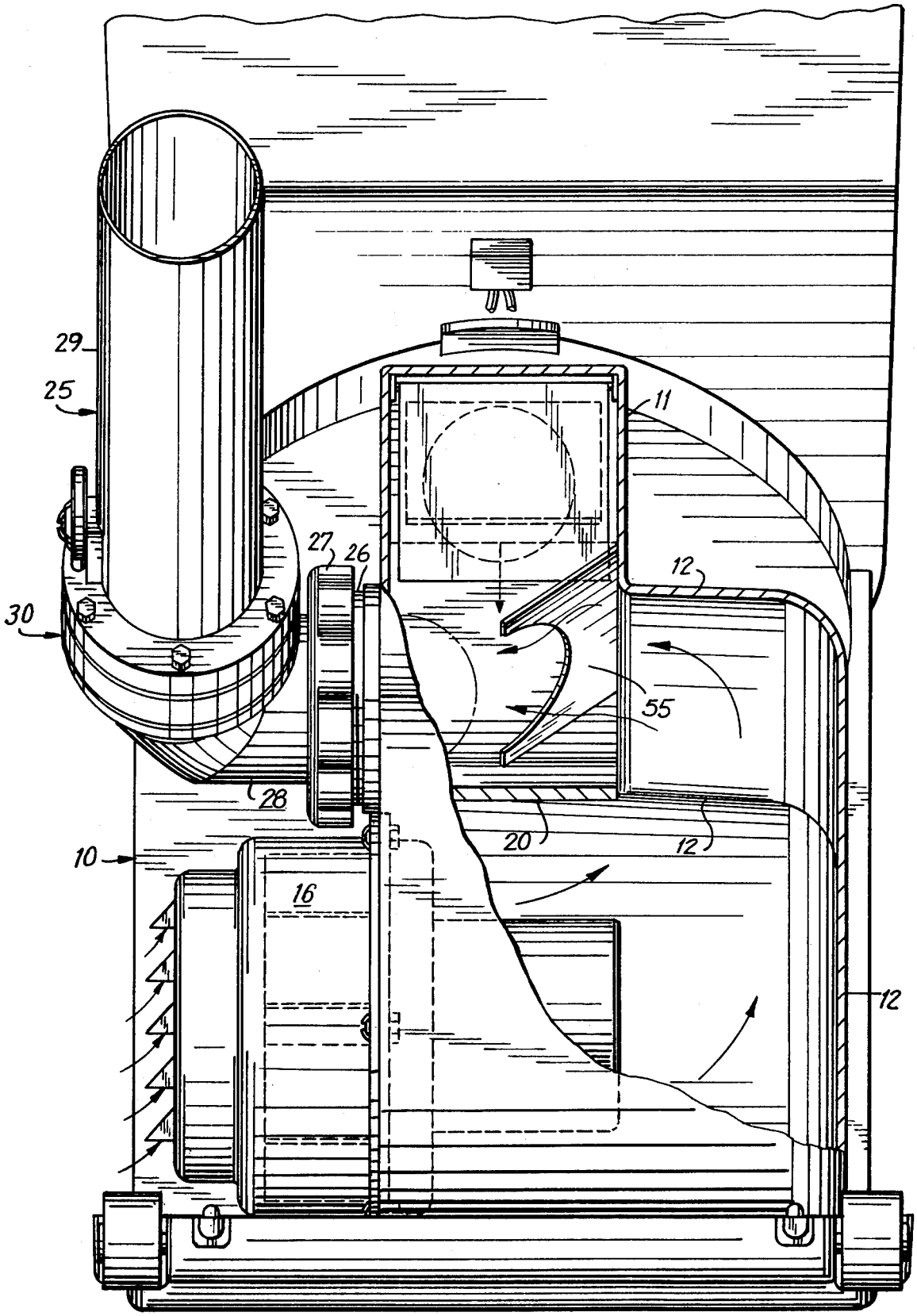
FIG. 4 is a partially broken away front elevation view of the complete device.
Figure 5:
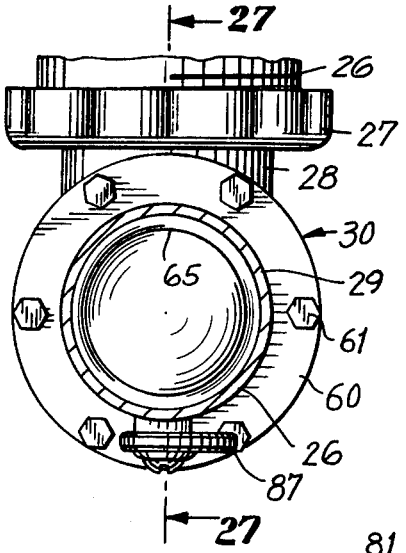
FIG. 5 is a top view showing the barrel of the projecting device.

When the gear motor 45 is activated, the blower motor 16 should also be activated, causing air to be blown through the air chamber 12 in the path shown by the arrows in FIGS. 3 and 4, around the baffle 55 and out the barrel 25. The flow of air passing around the baffle 55 provides a so-called "venturi effect", creating a decrease in pressure in the ball chute 21, below the flap valve 52, thereby causing the flap valve to remain open. Thus, when a ball in a dial opening 36 reached a position over the feeder opening 50, the ball can immediately drop through into the ball chute 21 without any resistance being caused by a closed flap valve, which might result in a jammed ball. The ball passes down the ball chute 21 and into the inner barrel 25 where it serves to constrict the flow of air through the air chamber and about the baffle 55, thereby eliminating the "venturi effect" and resulting in an increase in air pressure behind the ball and extending into the ball chute 21 and the pressure chamber 12. The increase in pressure causes the flap valve 52 to move upwardly and seal against the valve seat 150, thus permitting a further increase in pressure. The ball is in the meantime moved through the inner portion of the barrel 28 until it seats against the detent membrane 65, forming a substantially airtight seal thereagainst. The portion of the operation described thus far, results in the improvement provided by a "venturi effect" causing baffle which maintains the flap valve in an open position so as to eliminate the possibility of a ball being jammed against the flap valve, thus increasing the rate at which the ball can be permitted to fall through.

Further, the angle to the horizontal of the transverse surface 29 and of the feeder dial 34, and the relative position and angle of the guard ledge 58, serve to avoid any jam-up of balls into the feeder chute 21.

Figure 7:
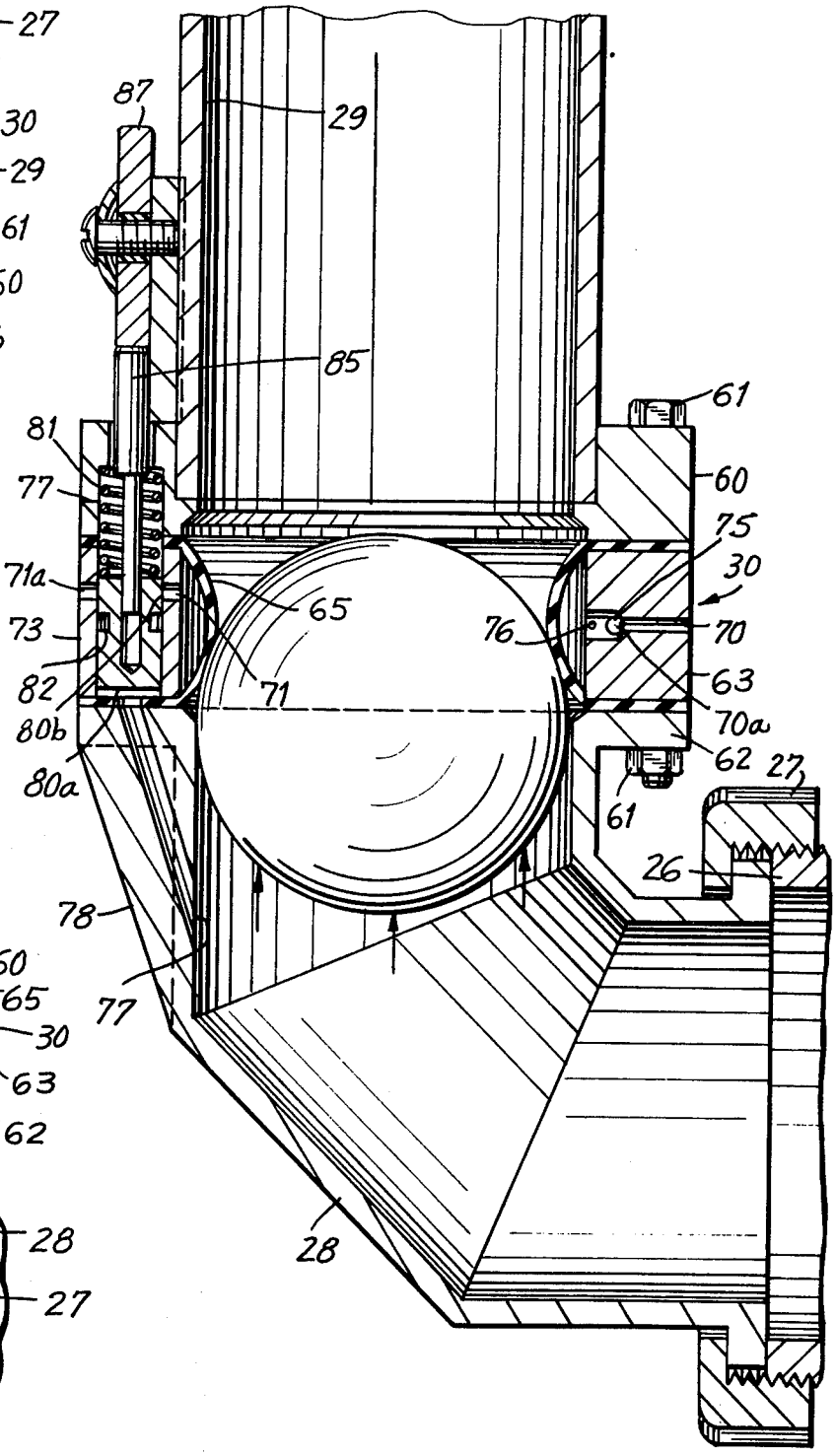
FIG. 7 is a sectional view along line 7—7 of FIG. 5.
Figure 6:
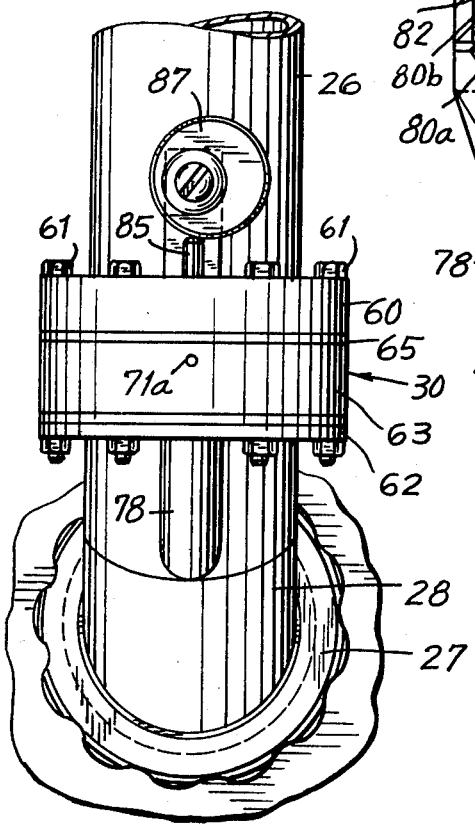
FIG. 6 is a side view of the barrel position.
Figure 9:
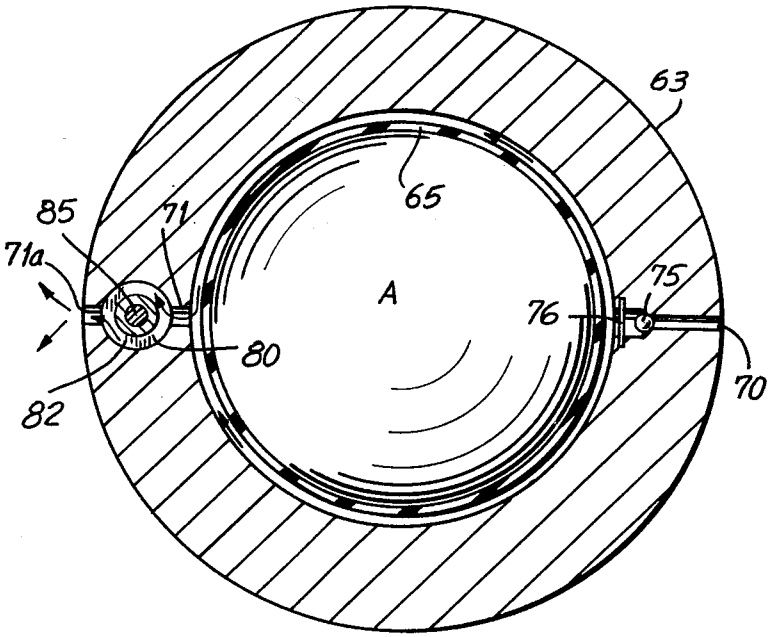
FIG. 9 is a sectional view taken along line 9—9 of FIG. 8.

As the third major area of improvement, the pneumatic detent means restraining the ball from passing through the barrel is provided with a regulating valve, which permits deflation of the detent means and release of the ball, in direct response to a specific air pressure being exerted thereagainst. In accordance with the pneumatic detent means of FIGS. 5–7, the membrane 65 is of a flexible resiliently elastic material which is in its neutral position as shown in FIG. 7, so as to define a sealed volume between the membrane and the flange member 63. The air which is within the volume is maintained at least at atmospheric pressure by the ball check valve 75. As the pressure within the air case 12 and thus within the inner barrel portion 28 increases, the pressure on the ball increases, pushing it against the membrane 65, causing a resultant increase in the air pressure within the detent volume 65, 63. This increased pressure is maintained by the ball check 75 seating against the valve seat **70*a* and by the normally biased closed position of the spool valve 80**.

Figure 8:
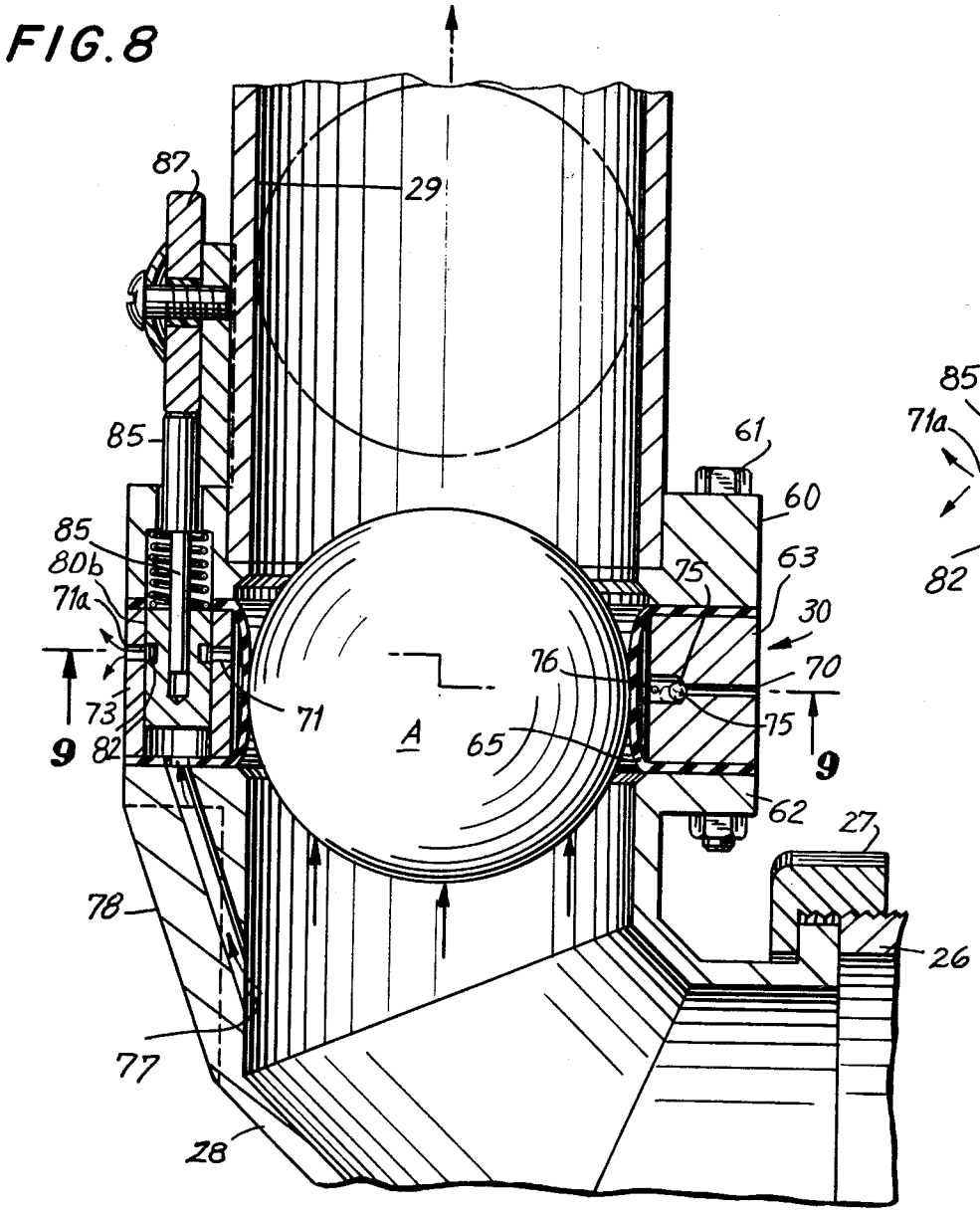
FIG. 8 is the same view as FIG. 7 showing the ball and retention means in a projecting position.

The pressure in the inner barrel member 28 is also exerted against the lower face **80*a* of the spool valve 80, tending to move it in an outward direction against the biasing action of the spring 81. As the pressure increases, the spool valve 80 is gradually moved outwardly until the annular notch 82 is in a position so as to connect the vent portions 71, 71*a*. At this point, the pressure within the detent volume 65, 63, is immediately released, permitting the deflation of the membrane 65 into a flattened position, as shown in FIG. 8, and thereby removing the impediment to the ejection of the ball by the pressure therebehind. Thus, the bias exerted by the spring 81 against the spool valve 80 directly increases the pneumatic pressure exerted against the ball at the time of ejection. As the pressure against the ball is directly related to the velocity at which the ball is ejected, the muzzle velocity of the ball is thereby directly regulated by varying the bias action of the spring 81 against the spool valve 80**.

The bias action is controlled by rotation of the eccentrically mounted dial 87. Thus, referring to FIG. 6, by rotating the dial 87 in a clockwise direction, the regulating stem 85 is caused to move downwardly into the valve chamber 77, compressing the spring 81 and thereby increasing the bias force acting against outward movement of the spool valve member 80. Similarly, moving the dial in a counterclockwise direction will result in a relaxation of the bias spring 81, during the bias action of the spring against the spool member 80, thereby permitting opening of the spool valve 80 at a lower pressure.

After the ball has passed through the detent means and out the barrel as shown in FIG. 8, the resilient membrane snaps back into its extended position as shown in FIG. 7, thereby decreasing the pressure in the detent volume 65, 63, and opening the ball check 75 so as to permit air to enter through vent 70. At the same time, the spool valve member 80 is pushed downwardly by the spring 81 against the outer surface of the membrane 65, as the pressure within the inner barrel 28 is decreased following expulsion of the ball. Thus, the system is ready for the next ball falling through the ball chute 21 from the feeder dial openings 36.

In the second embodiment of the pneumatically regulatable detent member, shown by FIGS. 10–12, the ball is also restrained by the inflated detent membrane 65. However in this embodiment, the pressure exerted against the spool valve member 177, is tapped from the detent volume 65, 163. This avoids the possibility of grit or other interfering substance entering into the spool valve area from the inner barrel 28. This is especially significant when tennis balls are being projected and the fuzz from the tennis balls can create a serious dust problem within the spool valve, often causing clogging or jamming thereof. In FIG. 12 the position of the tennis ball and the detent membrane, as well as of the spool valve 177, and bias spring 179, in the detained position, is shown by the phantom lines. The ball in the ejected condition, with the spool valve open and the membrane collapsed, is shown in solid lines.

The embodiment of FIGS. 10–12 also differs from that of FIGS. 5–9, by the means through which the spool valve bias force is regulated. It must be pointed out that the bias regulating means can be interchanged and is not limited to the particular embodiments shown herein; that is, the regulating means of FIGS. 5–9 can be utilized in the detent embodiment of FIG. 12 and vice versa.

In accordance with this second embodiment, the bias action of the spring is regulated by plunger 80, which in turn is locked in place by rat trap spring 182. When the plunger is vertically moved into or out of the case 175, the spring is compressed or expanded, respectively. The rat trap spring 182, pressing against the flattened concave portion 181 of plunger 180, serves to lock the plunger into position, not permitting the plunger to move as the spool valve member 177 presses outwardly against the bias spring 179 until it is moved to the open position shown in the solid lines in FIG. 12. The spool valve 177 snaps back against the membrane 65 after the ball has been ejected from the barrel and until a subsequent ball presses against the detent membrane causing the pressure cycle to repeat.

In the third embodiment of the relief valve for deflating the detent member, a simple ball check is utilized, and the pressure from the detent volume acts directly against the ball valve surface, as in the embodiment of FIGS. 10–12. Although the bias force acting against the valve ball 201 by the spring 271 can be regulated by adjusting the threaded plug 28 towards or away from the check ball, the speed of the projected ball can also be modulated by adjusting the proportion of the openings 231 exposed to the atmosphere. The sleeve 233 can be so placed as to completely cover the openings 231, as shown in FIG. 14, completely expose the openings as shown in FIG. 14, or cover any intermediate proportion of the openings 231. Increasing the proportion of the openings 231 covered by the sleeve 233, increases the muzzle velocity of a projected ball.

The greater the proportion of the outer barrel length located downstream of the openings 231, the greater the effect of the openings. Accordingly, preferably the axial distance between the openings 231 and the exhaust end of the outer barrel 233 is at least about a multiple of 1.5 times the diameter of the ball being projected and optimally at least about 2.5 times the diameter of the ball. In the tennis ball projecting embodiment shown in the drawings, the barrel internal diameter is about 2.6 inches, the upstream ends of openings 231 are located about 1¼ inches from the midpoint of the membrane 65, and the length of the outer barrel is about 12 inches.

It is noted that in the first embodiment above, the valve is moved to a substantially fully open position by the pressure behind the ball, in the air box. In the latter two embodiments, the valve is most likely just cracked sufficiently to permit a lowering of the pressure in the detent volume sufficient to widen the diameter of the central space defined by the membrane 65 enough to permit passage of the ball to be projected. All of the embodiments, however, deflate the membrane substantially immediately to permit the sharp and sudden release of the ball, in the most desirable manner.

An advantage of the embodiments shown in the enclosed drawings is that they are all capable of handling balls of relatively widely varying diameters and hardness. A problem especially often encountered with tennis balls is the variation in diameters caused by imprecise manufacturing tolerances and further by the age of the ball: an older, "dead", ball is not only softer, but also of smaller diameter, than a new fresh, "live" ball. None of these balls is likely to jam the pneumatic detent means of the present invention.

Another advantage of the embodiments of the enclosed drawings is that they can be readily molded out of plastic and provide an extremely simple and compact system for a tennis ball throwing practice machine. The hopper 32, as shown, is removable from the operating position shown in the drawings and can be reversed and used as a cover for the entire device, as shown in FIG. 1*a*.

As a further improvement in the present invention, the case 10 is supported upon a turntable base 14, which is turned in an oscillating motion by gear motor 15 and bearing 17. The barrel is thus made to move back and forth across a predetermined arc, thereby providing a variety of angles at which the ball is projected across the net and to the practice player. Often, it is of course desirable not to operate the oscillating device and in such cases the motor 15 can be independently shut off while the blower and dial motor 45 are operating. Similarly, the angle of elevation of the barrel can be readily varied by loosening the knurled hand tight nut 27 and turning the barrel upwardly or downwardly into any desired angular elevation. Any other combination of apparatus can be used with any one of the improvements defined above; however, as indicated, it is preferred that all of the improvements be used in a single most preferred embodiment.

The detent membrane 65 can be formed of a variety of resiliently elastic materials, such as natural rubber, and synthetic rubbers.

The membrane is biased towards the inflated condition, e.g., as in FIG. 7, preferably only by the natural elasticity of the membrane material. In order to obtain the greatest benefit from this invention, this biasing action optimally should be just sufficient to move the membrane back to the inflated condition after the ball has passed through, but should interfere as minimally as possible with the passage of the ball, once the pressure valve has opened. For example, the membrane should collapse, when projecting tennis balls, preferably with a pressure deferential of as little as about 0.5 psi gauge acting on the ball.

The embodiments of the present invention which are claimed are as follows:

1. In a pneumatic device for projecting a ball, the device comprising a ball-directing tube defining a generally tubular inner space, gas pressure supply means operatively connected to a first end of the tube to provide gas under pressure thereto, means for feeding a ball to the tube for movement in a direction from the first end toward the second end, and detent means in the tube for transiently restraining the movement of a ball therethrough, the improvement comprising:

providing as the detent means a pneumatically operated detent means, the detent means comprising:

an inflatable, elastically biased membrane within said tube, the membrane having a first inflated configuration extending into the tubular inner space, so as to define a substantially pressure-tight detent volume, and being biased towards the inflated configuration, so as to constrict the tubular inner space and thus restrain the movement of a ball therethrough;

pressure valve means between the detent volume, and the atmosphere;

bias means operatively connected to the pressure valve means and acting to move the pressure valve means into a closed position;

a pressure-responsive means operatively connected to the pressure valve means and acting against the bias means, tending to move the valve means into an open position; and a pressure chamber and a pressure-connecting means between the pressure-responsive means and the pressure chamber, the pressure in such chamber being increased when a ball is in place in the tubular inner space and being restrained by the detent membrane, while gas under pressure is being provided to the first end of the tube, whereby at a predetermined pressure in the pressure chamber, the pressure valve means is moved into the open position, so as to substantially immediately permit the deflation of the membrane when a ball is pressed thereagainst and permit passage of the ball therethrough.

2. The device of claim 1 wherein the inflatable membrane is in the form of an annular ring which defines an annular detent volume within the tubular space.

3. The pneumatic device in accordance with claim 2 wherein the pressure chamber comprises the detent volume defined by the detent membrane.

4. The pneumatic device in accordance with claim 2 wherein the pressure chamber comprises the tubular inner space between the detained ball and the gas pressure supply means.

5. The pneumatic device in accordance with claim 2 wherein the bias means comprises a spring member.

6. The pneumatic device of claim 1 comprising, in addition, regulating means to regulate the velocity of a ball projected from the second end of the tube, the regulating means comprising, means defining an opening through the ball-directing tube at a location between the detent means and the second end of the tube, and covering means operably connected to the tube for covering and uncovering the opening, whereby the thrust against a ball passing along the tube can be varied.

7. The pneumatic device of claim 6, wherein the covering means comprises sleeve means, slidably connected to the tube and capable of movement along the length of the tube so as to cover any desired portion of the opening.

8. The pneumatic device of claim 7 comprising in addition a check valve between the detent volume and the atmosphere so positioned to permit the flow of air into the detent volume when the pressure therein is below atmospheric.

9. The pneumatic device of claim 7 wherein the covering means includes means for maintaining a pre-set position along the tube.

10. A pneumatic device for projecting a ball, the device comprising an air box; and gas pressure flow means located therewithin; a ball projection barrel supported on said air box and having an outer portion through which the balls are projected and an inner portion in fluid flow connection with said air box; ball feed channel means extending to the barrel; and a ball feeding means for feeding balls, one at a time, to the feed channel, the feeding means comprising:

a chamber having side walls disposed in a substantially vertical direction and a floor, a portion of the floor being inclined to the horizontal at an angle in the range of from about 35° to about 50°; a feeder disk having a plurality of openings formed therethrough, the disk being rotatably connected to and disposed above the inclined floor surface and being substantially parallel thereto, the floor surface having a ball feed opening so positioned as to be in register with the openings through the disk at the apogee of each opening as the disk rotates; drive means for rotating disk; a raised central portion on the disk extending outwardly and upwardly into the chamber and having a circumferential side surface; a ledge member supported from a side wall surface of the chamber, and having a shelf surface extending outwardly above the upper portion of the disk so that the outer edge of the ledge shelf surface extends along a line forming a chord of the disk and of a disk opening when such opening is in register above the ball feed opening; a transverse ledge surface extending downwardly from the outer edge of the shelf surface, towards the disk; and movable sealing means for the ball feed opening capable of permitting a ball to be fed from the feeder disk when the disk opening is in register with the feeder opening and of sealing the opening after feeding of a ball, whereby pressure in the air box can be increased to a desired pressure for ejecting the ball.

11. The pneumatic device of claim 10 wherein the movable sealing means comprises a panel pivotally connected to and beneath the floor surface, adjacent the ball feed opening, and being displaceable downwardly by its own weight; and comprising in addition flow restricting means between the gas pressure flow means and the ball feed channel so as to provide a venturi effect within the ball channel means, thus resulting in a decrease in pressure therein, whereby the hinged panel is further urged into the open position.

12. The pneumatic device of claim 11 wherein the distance between the vertical ledge surface and the circumferential surface of the raised disk portion, along a radius of the disk passing through a disk opening, is from about ⅛ to about 1/32 inch less than the diameter of a ball to be projected.

13. The pneumatic device of claim 12 comprising in addition a releasable detent means in the barrel for transiently restraining the movement of a ball therethrough until a predetermined air pressure is built up behind the ball in the barrel and air box to release the ball for projection out of the barrel.

14. The pneumatic device of claim 10 wherein the gas pressure flow means is an air blower having inlet means in fluid flow connection to the atmosphere and outlet means in fluid flow connection to the air box.

15. The pneumatic device of claim 14 wherein the flow restricting means comprises a baffle positioned within a fluid flow conduit into the ball channel means so as to produce the desired venturi effect.

16. The pneumatic device of claim 15 comprising in addition restrictor means for closing off one or more of the disk openings, whereby the rate of projection of the balls can be varied without varying the speed of rotation of the disk.

17. The pneumatic device of claim 15 wherein the raised central portion of the disk is castellated.

18. The pneumatic device of claim 17 comprising in addition cylinder means positioned beneath and in register with each of the disk openings so as to direct the ball through the floor opening and into the ball channel.

19. The pneumatic device of claim 18 wherein the inclined floor is distanced from the feeder disk so as to permit the lower surface of a ball in a disk opening to roll therealong.

20. The pneumatic device of claim 10 wherein the disk is positioned at an angle of about 45° to the horizontal.

21. In a pneumatic device for projecting a ball, the device comprising a ball-directing tube defining a generally tubular inner space, gas pressure supply means operatively connected to a first end of the tube to provide gas under pressure thereto, means for feeding a ball to the tube for movement in a direction from the first end toward the second end, and detent means in the tube for transiently restraining the movement of a ball therethrough, the improvement comprising:

providing as the detent means a variable, pressure-regulated, pneumatically operated detent means the detent means comprising:

an inflatable, elastically biased membrane within said tube, the membrane having a first inflated configuration extending into the tubular inner space, so as to define a detent volume, and being biased towards the inflated configuration, so as to constrict the tubular inner space and thus restrain the movement of a ball therethrough;

pressure valve means between the detent volume, and the atmosphere;

variable bias means operatively connected to the pressure valve means and acting to move the pressure valve means into a closed position;

control means for the variable bias means for regulating the force exerted by the bias means;

a pressure-responsive means operatively connected to the pressure valve means and acting against the variable bias means, tending to move the valve means into an open position; and a pressure chamber and a pressure-connecting means between the pressure-responsive means and the pressure chamber, the pressure in such chamber being increased when a ball is in place in the tubular inner space and being restrained by the detent membrane, while gas under pressure is being provided to the first end of the tube.

22. The device of claim 21 wherein the inflatable membrane is in the form of an annular ring which defines an annular detent volume within the tubular space.

23. The pneumatic device in accordance with claim 22 wherein the bias means comprises a spring member.

24. The pneumatic device of claim 23 wherein the control means for the variable bias means comprises a slidable rigid member juxtaposed against the spring so as to limit movement of the spring between the valve means and the control means.

25. The pneumatic device in accordance with claim 21 wherein the pressure chamber comprises the detent volume defined by the detent membrane.

26. The pneumatic device in accordance with claim 21 wherein the pressure chamber comprises the tubular inner space between the detained ball and the gas pressure supply means.

* * * * *